US006341983B1

(12) United States Patent
Crawford et al.

(10) Patent No.: US 6,341,983 B1
(45) Date of Patent: Jan. 29, 2002

(54) CO-MOLDED SEAL AND STRAIN RELIEF FOR AUTOMOTIVE ELECTRICAL CONNECTIONS

(75) Inventors: Richard J Crawford, Girard; Randy L. Fink, Warren; Anthony Raschilla, Girard; Kenneth Lisowski, Lordstown, all of OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/543,074

(22) Filed: Apr. 5, 2000

(51) Int. Cl.[7] ..... H01R 13/40
(52) U.S. Cl. ..... 439/587; 439/275; 439/519
(58) Field of Search ..... 439/587, 588, 439/589, 279, 275, 519, 520

(56) References Cited

U.S. PATENT DOCUMENTS 4,973,268 A * 11/1990 Smith et al. ..... 439/595
5,593,321 A * 1/1997 Hotea ..... 439/589
5,634,807 A * 6/1997 Saito ..... 439/275

* cited by examiner

*Primary Examiner*—Tho D. Ta
*Assistant Examiner*—Ann M McCamey
(74) *Attorney, Agent, or Firm*—Thomas A. Twomey

(57) ABSTRACT

A high density seal connector for use in an automotive vehicle. The connector includes a strain relief member when the strain relief member has an outer frame which in part defines the connector. The strain relief member further includes a protective inner cover which is attached to an inside surface of the frame. The inner cover also includes an inside surface and an outside surface which has a plurality of orifices therethrough. The connector also includes a resilient seal member which is molded directly to the inside surface of the inner cover. The seal member includes a plurality of seal plugs which fill a predetermined number of the orifices of the inner cover.

20 Claims, 3 Drawing Sheets

CO-MOLDED SEAL AND STRAIN RELIEF FOR AUTOMOTIVE ELECTRICAL CONNECTIONS

BACKGROUND OF THE INVENTION

1. Field of the Invention

The present invention relates to electrical connectors, and more particularly relates to a co-molded seal and strain relief member for an automotive electrical connection.

2. Description of Related Art

It is well known in the art to use high density connection systems in automotive vehicles. The current state of design technology for high density connection systems uses multiple components that are assembled and contained within one housing. The prior art technology has a large number of cavities and multiple components that must be assembled after manufacturing of each component. The insertion of terminals into the connector cavities is very difficult during and after this manufacturing process. This difficulty can be traced to the fact that the typical center line of a cavity is 2.5 mm and the expansion of the connector seal or any ability of the seal to move independently from the strain relief member during insertion of the terminals will cause a mismatch with the center lines between the seals and the strain relief member. The mismatch between the seal and the center line of the strain relief member will cause leakage and environmental contaminants to penetrate to the terminals thus causing an abnormality in the electrical connection of the automotive vehicle. Therefore, the prior art has consisted only of strain relief members being assembled with separately created seal assemblies and then having the terminal inserted after the seal assemblies are connected to the strain relief members. This increases the cost of manufacturing.

Therefore, there is a need in the art for an environmentally sealed electrical connection for use in an automotive vehicle. This electrical connection should be sealed such that any electrical terminals being used within the connection are free from any environmental contaminates found in everyday road use.

SUMMARY OF THE INVENTION

One object of the present invention is to provide an improved co-molded seal and strain relief member for use in an electrical connection system.

Another object of the present invention is to provide an electrical connection that has improved ease of wire assembly.

Yet a further object of the present invention is to provide an electrical connection that has superior sealing properties.

Still a further object of the present invention is to provide an electrical connection that does not require a foreign substance, such as gel compound, to enter the female electrical terminal.

Still a further object of the present invention is to provide an electrical connection that has center line control achieved through bonding the cable connector seal to the strain relief member.

Still a further object of the present invention is to eliminate seal creep during the manufacturing process, thus eliminating any mismatch with the center lines causing terminal insertion difficulties.

Still a further object of the present invention is to provide an electrical connection that enhances visual indication of molding for the manufacturing process.

Yet, a further object of the present invention is to provide a cost savings by reducing parts required for customers specific requirements and electrical connection systems.

To achieve the foregoing objects, the high density seal connector includes a strain relief member. The strain relief member has an outer frame which in part defines the connector. The strain relief member further has a protective inner cover attached to an inside surface of the frame. The inner cover has an inside and outside surface with a plurality of orifices therethrough. The high density seal connector also includes a resilient seal member molded to the inside surface of the inner cover. The seal member also includes a plurality of seal plugs. The seal plugs fill a predetermined number of the orifices within the inner cover.

One advantage of the present invention is that it creates improved wire assembly techniques for electrical connectors.

A further advantage of the present invention is the superior sealing properties of the electrical connection.

A further advantage of the present invention is an electrical connection that can be assembled without a gel compound entering the electrical female terminal when passing through the seal.

A further advantage of the present invention is that the electrical connection provides enhanced center line control with the bonding of the connector seal to the strain relief member.

A further advantage of the present invention is the elimination of seal creep during the manufacturing process which also eliminates the mismatch of center lines which will remove any terminal insertion difficulties.

Still another advantage of the present invention is the enhancement of the visual indication of a non-used terminal hole for the manufacturing process.

Still another advantage of the present invention is the cost savings as found by reducing part numbers for customers specific requirements for the electrical connection.

Other objects, features, and advantages of the present invention will become apparent from the subsequent description and appended claims, taken in conjunction with the accompanying drawings.

DESCRIPTION OF THE PREFERRED EMBODIMENT(S)

Figure 8:
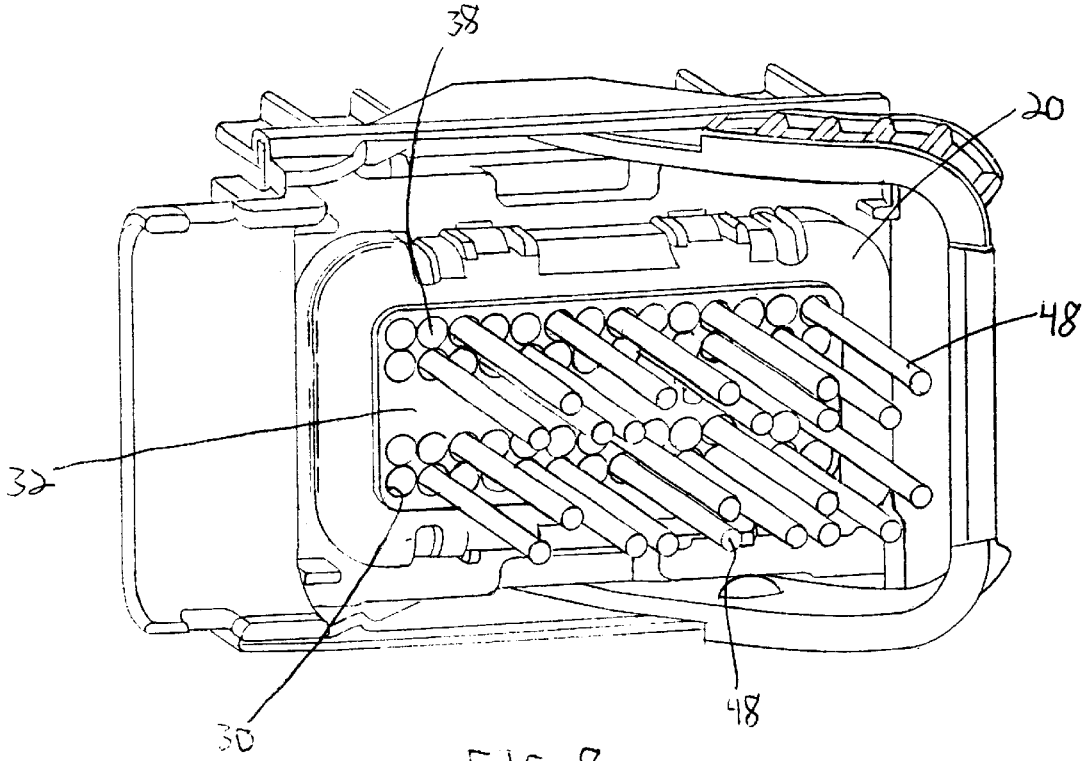
FIG. 8 shows a plan view of the present invention with electrical terminals inserted in the opened cavities.

Referring to the drawings, the co-molded seal and strain relief member 18 according to the present invention is shown. Current technology for high density and environmentally sealed connections or connection systems use multiple components that generally include a seal and strain relief member that are assembled into one housing. These systems are generally utilized in a sealed automotive electrical connection system which is used for mating electrical wiring harnesses to environmentally exposed control modules or equivalent electrical connections. The current state of the art connection assemblies for automotive vehicles generally uses sealed electrical connections incorporated therewith a multiple cable seal and a separate wire strain relief which prevents excessive stress on the electrical terminals in the connection/connector.

Figure 1:
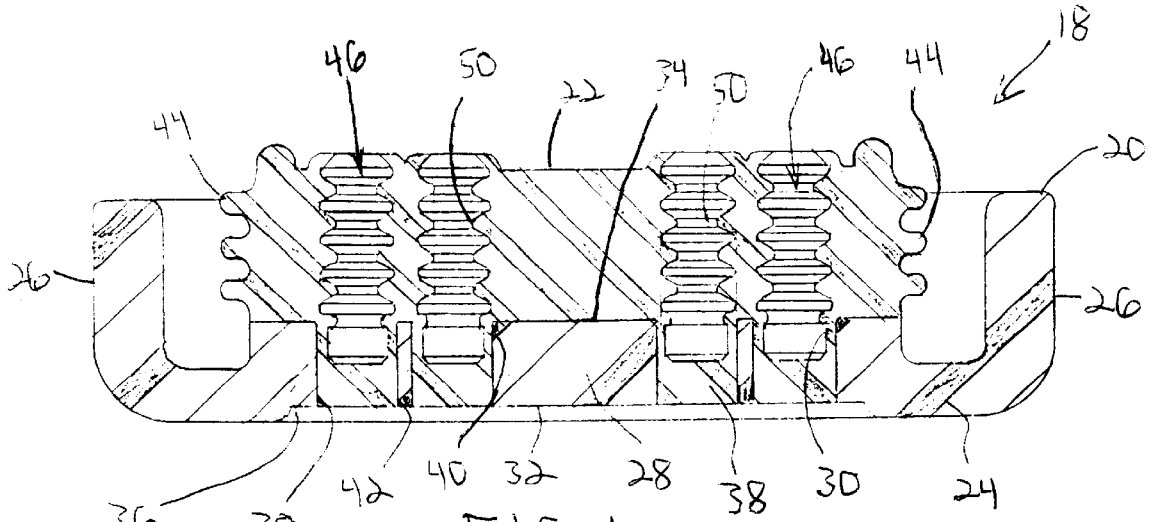
FIG. 1 shows a cross section of the present invention.
Figure 2:
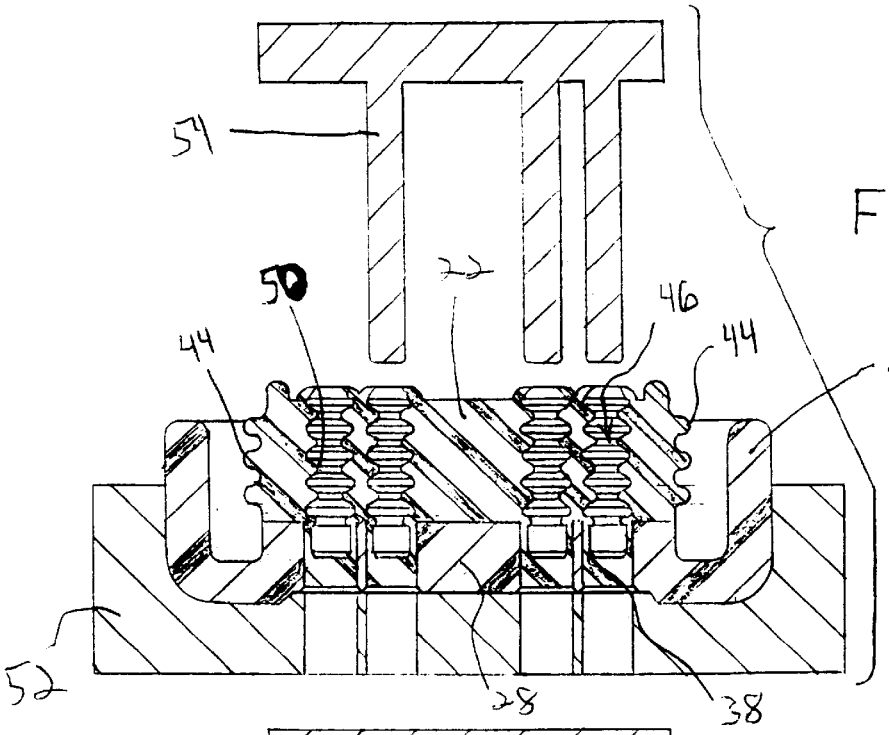
FIG. 2 shows a cross section of the present invention along with the seal punching tool.
Figure 3:
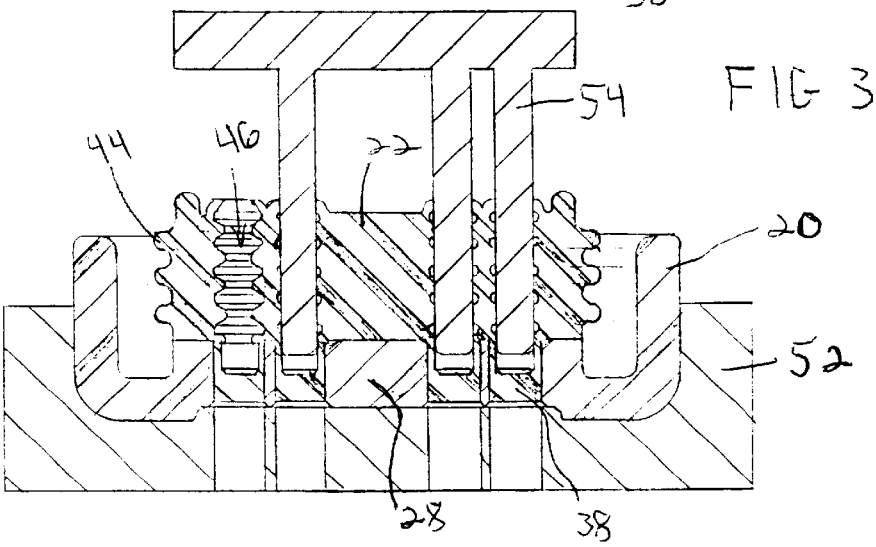
FIG. 3 shows a cross section of the present invention and the insertion of the seal punching tool.
Figure 4:
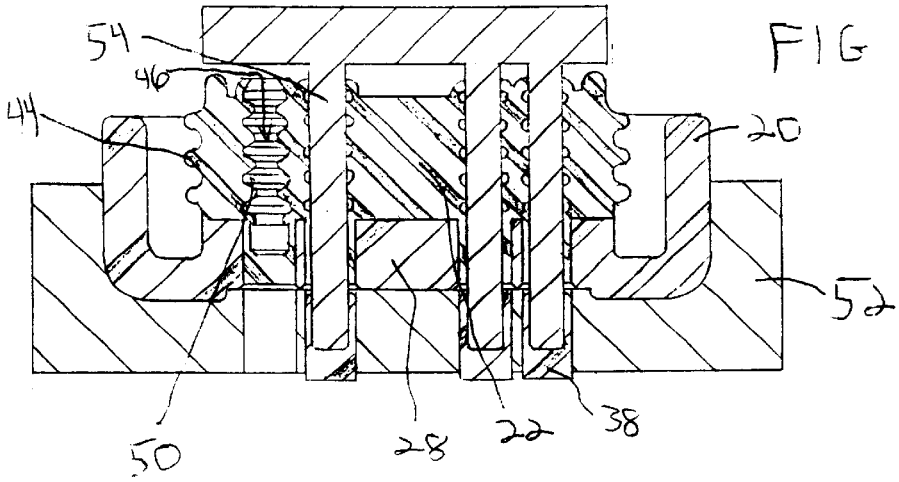
FIG. 4 shows a cross section of the present invention with removal of the seal plugs.
Figure 5:
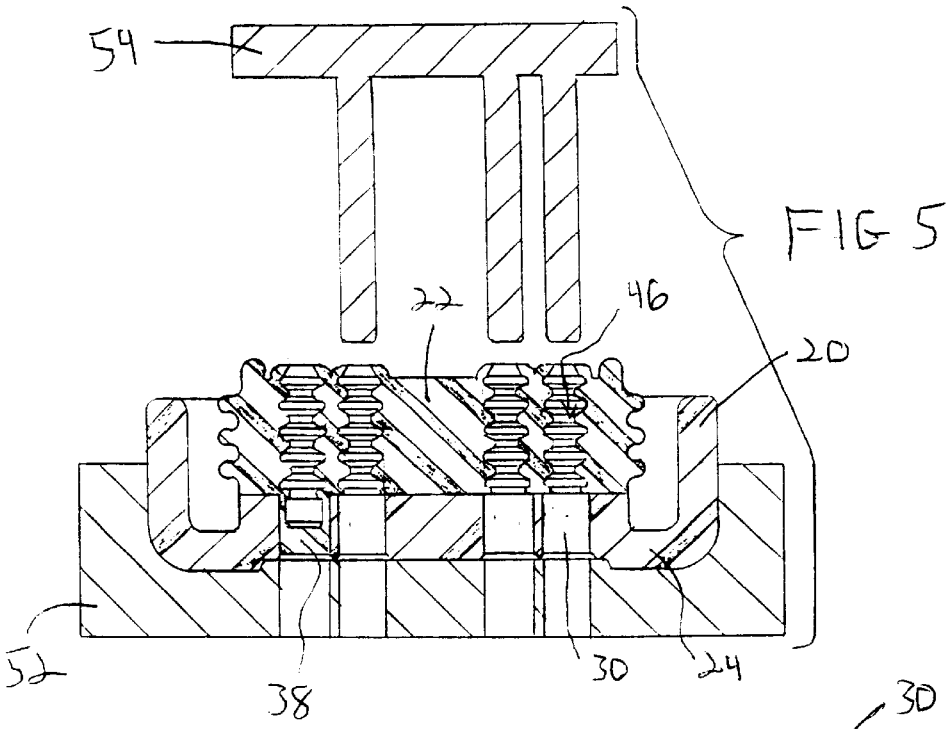
FIG. 5 shows a cross section of the present invention with the seal punching tool being removed.
Figure 6:
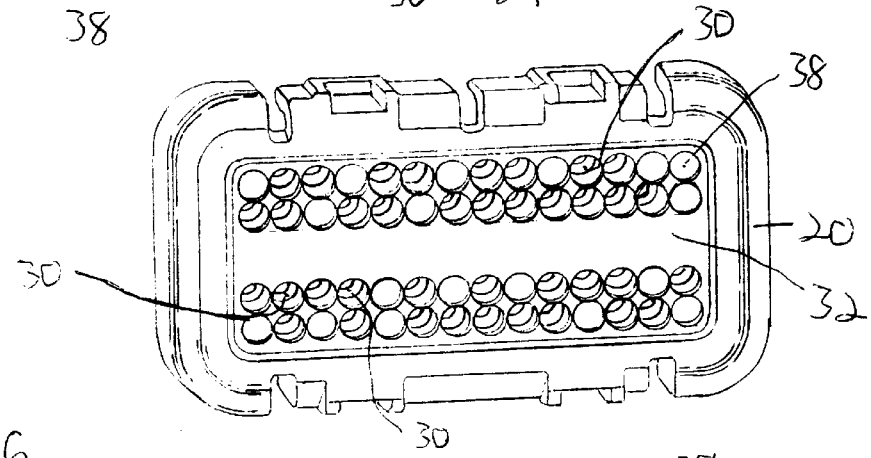
FIG. 6 shows a plan view of the present invention with selected seal plugs removed.
Figure 7:
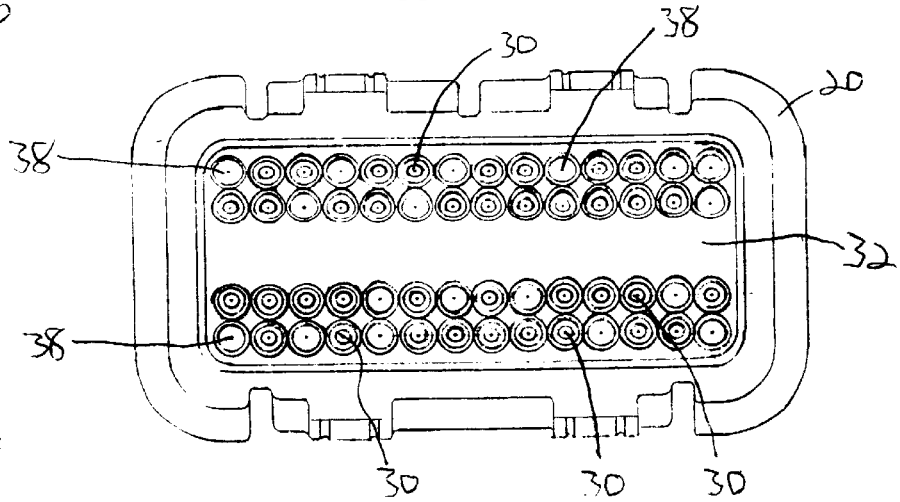
FIG. 7 shows a front on view of the present invention with selected seal plugs removed.

At As shown in FIG. 1, the present invention has a design that combines that strain relief member 20 and the environmental seal member 22 into one unit. The strain relief member 20 is generally made of a rigid material and in the preferred embodiment a plastic material is used but it should be noted that any other rigid material such as metal, ceramics, composites or any other type of hard plastics may be used according to the present invention. The strain relief member 20 generally has a U-shaped cross section. The strain relief member 20 generally has a body portion 24 which has a wall 26 extending from each end thereof. Extending from an inside surface of the body 24 is a panel or inner wall 28 which includes a plurality of orifices 30 therethrough. The inner wall 28 includes an outer surface 32 and an inside surface 34. The outer surface 32 of the strain relief member 20 is generally indented or recessed 36 with respect to an outside surface of the body member 24.

The environmental seal 22 is the second component used to create the co-molded seal and strain relief member 18. The seal 22 is made of a resilient material and in the preferred embodiment the resilient material is a silicone rubber but it should be noted that any other equivalent resilient material such as other rubbers or other composites may be used depending on the environment and manufacturing requirements. The seal 22 is molded directly to the inner surface 34 of the strain relief member 20. The seal 22 is molded such that the silicone rubber or equivalent material fills the entire wire pass through orifices 30 in the panel 28 of the strain relief member 22. This will ensure that all potential leak paths are closed in the connection system. The integrated seal plugs 38 or the silicone rubber that fills the wire pass through holes or orifices 30 are connected to the main seal body 22 by a circular connection 40. The integrated seal plugs 38 are molded such that they create a planar or flat surface 42 with the outside surface of the strain relief panel 32. The integrated seal plugs 38 are connected only at the outer edges of the circumference of the orifices 30 in the strain relief panel 28. The seal member 22 also includes a plurality of ribs 44 on its outer surface. The seal member 22 also includes a plurality of cavities 46 which align with each orifice 30 in the strain relief panel 28. These cavities 46 are where the terminals 48 will be inserted through the co-molded seal and strain relief member 18. The inner wall of the cavities include a plurality of sealing ribs 50 which will create an environmental seal after insertion of the terminal wire 48. The molding of the seal 22 to the strain relief member 20 allows for a fixed alignment of the seal cavities 46 with the orifices 30 of the strain relief member. This will ensure that the centerline of the environmental seal member 22 does not shift or allow for any seal creep during the manufacturing process. With the environmental seal fixed and fastened to the strain relief member 20 the insertion of the terminal wires 48 will not cause any shifting in the environmental seal thus eliminating any possibility of leakage due to misaligned centerlines between the seal 22 and strain relief member 20.

After the seal member 22 is molded to the strain relief member 20 a selective or predetermined number of the integrated seal plugs 38 are removed by a punch press process. As shown in FIGS. 2–7, after the initial molding of the seal 22 to the strain relief member 20 a combined co-molded seal and strain relief member 18 is placed into a punch press 52. Then the selected seal punching tool 54 which corresponds to the wiring pattern for the specific connector is inserted into the press 52. The punching tool 54 is inserted into the selected cavities 46 of the seal member 22 and is moved in the cavity 46 until the seal punch tool 54 punches and removes the selected integrated seal plugs 38 from the selected orifices 30 in the strain relief member 20. Then the seal punching tool 54 is removed from the seal member 22 and the internal sealing ribs 50 return to their original configuration after removal of the punching tool 54. With the removal of the selected integrated seal plugs 38 the cavity 46 in the seal member 22 is opened through the selected orifices 30 and the strain relief member 20 creating a hole which can be used to insert an electrical terminal 48 therethrough. This will allow for an environmentally sealed connection around the terminal 48 via the internal sealing ribs 50 of the seal member 22. With only selective integrated seal plugs 38 removed during the punch press operation this also creates the further benefit of a visual indicator, for those working in the manufacturing process, of which cavities 46 actually require terminal insertion during the next step of the manufacturing process. Furthermore, an electrical terminal cannot be accidentally inserted into a cavity because any cavity not selectively punched still includes the seal plug 38 and will not allow the insertion of an electrical terminal 48 therethrough. Hence, the selectively punched strain relief and seal member 18 is environmentally sealed to any contaminates because those holes not used for terminal insertion still include the seal plug 38 while those that have a terminal inserted within the cavities 46 use the internal seal ribs 50 of the seal member 22 to create a completely environmental tight seal about the terminal inserted in the cavity. It should further be noted that the specific pattern for the seal punch is changed with great ease thus allowing various customers to have unique wiring designs for use in the connection system. All that has to be changed to create a unique co-molded strain relief and seal member is the punching tool punch inserts. Therefore, manufacturing downtime is reduced to almost zero, thus, reducing costs to the manufacturers of the automotive vehicles.

It should also be noted that in another embodiment of the present invention the selected removal of the seal plugs 38 may occur during the molding operation i.e. whichever cavities must remain open of insertion for an electrical terminal 48 will be molded in an open state and the integrated seal plugs 38 will only be molded into those orifices 30 that will remain closed throughout the life of the electrical connector. However, it should be noted that the preferred embodiment is the technique of molding all the plurality of orifices 30 with integrated seal plugs 38 and then selectively removing them per instructions from customers via the punching process. The present invention allows removal of the silicone rubber integrated seal plugs 38 from the rigid plastic area of the strain relief member 20 without removing or damaging the internal seal ribs 50, thus providing an environmental seal to the cable or the terminal inserted therethrough. The design will also allow the cavities that are not required during terminal insertion to remain closed and environmentally sealed.

The co-molding of the seal member 22 to the rigid strain relief member 20 allows for a large number of terminal or leads 48 to be placed in a small area while still providing a waterproof seal for the entire connector assembly. This will enable the high density seal connector to work as designed in the hostile environment of an automotive vehicle. The new co-molded member also creates a cost reduction that is realized through the significant reduction of misplugged wires through the strain relief seal area of the connector. There is also a reduction in cost via repair and retesting which can lead to scrap with the harness and components which increases cost in the manufacturing process. This increases the quality of first time manufacturing. The seal performance is also superior because of the direct connection through the molding process of the seal 22 to the strain relief member 20. Furthermore, the inventory costs are reduced because one part is now used in a system that routinely and generally use two to complete the same process.

It should also be noted that the co-molded design of the present invention enables a large number of wires and leads to be inserted into the finished connector with the traditionally used 0.254 mm center lines. However, it should be noted that any other size centerline can be used and designed for the present invention as disclosed. In prior art connectors, a separate silicone rubber seal would expand as the wires were plugged through it. As the rubber expanded in those prior art devices the holes would be compressed closed where they would move off-center with relationship to the holes of the strain relief member. As the connector was filled up with wires and leads it became more difficult to insert the leads through the seal member. The present invention as described which includes a co-mold feature uses the rigid strain relief member to hold the silicon seal member cavities on center with the strain relief member and thus control the wire expansion as wires are inserted into the connection system.

The present invention has been described in an illustrative manner, it is to be understood that the terminology which has been used is intended to be in the nature of description rather than of limitation.

Many modifications and variations of the present invention are possible in light of the above teachings. Therefore, within the scope of the appended claims, the present invention may be practiced otherwise than as specifically described.

What is claimed is:

1. A high density seal connector, said connector including:

a strain relief member, said strain relief member having an outer frame which in part defines the connector, said strain relief member having a protective inner cover extending from an inside surface of said frame, said inner cover having an inside surface and an outside surface, said inner cover having a plurality of orifices therethrough; and a resilient seal member molded to said inside surface of said inner cover, said seal member having a plurality of removable seal plugs, said seal plugs fill a predetermined number of said orifices.

2. The high density seal connector of claim 1 wherein said seal plugs are removed by a punching mechanism.

3. The high density seal connector of claim 1 wherein said selected orifices are molded open.

4. The high density seal connector of claim 1 wherein said strain relief member will secure said seal member on a predetermined center line.

5. The high density seal connector of claim 1 wherein said seal plugs create a visual indicator for said connector.

6. The high density seal connector of claim 1 wherein said seal member has a plurality of ribs on an outside surface.

7. The high density seal connector of claim 1 wherein said seal member having a plurality of cavities, said cavities having one end thereof sealed by said seal plugs.

8. The high density seal connector of claim 7 wherein said cavities have a plurality of ribs.

9. A co-molded seal and strain relief member for use with selective seal punching, said member including:

a rigid strain relief member, said strain relief member having an outer frame, said strain relief member having a panel integral with said frame, said panel having an inside and outside surface, said strain relief member generally having a U-shaped cross-section, said strain relief member having a plurality of orifices in said panel; and a resilient seal molded to said inside surface of said panel, said seal having a plurality of cavities which align with said orifices of said panel, said cavities having ribs on a surface thereof, said ribs extend to said inside surface of said panel, said seal having a plurality of seal plugs which fill said orifices in said panel, said seal plugs connect to a main body of said seal near said inside surface of said panel, an opposite end of said seal plug creates a planar surface with said outside surface of said panel, at least one of said seal plugs are selectively removed from said orifices.

10. The co-molded seal and strain relief member of claim 9 wherein said seal plugs are selectively removed by a punching tool.

11. The co-molded seal and strain relief member of claim 9 wherein said seal plugs are selectively removed during said molding.

12. The co-molded seal and strain relief member of claim 9 wherein said cavities and said orifices having a specific fixed centerline created by a bond during said molding.

13. The co-molded seal and strain relief member of claim 9 wherein said seal plugs create a visual indicator for predetermined punch patterns.

14. The co-molded seal and strain relief member of claim 9 wherein said strain relief member and said seal create an environmentally sealed electrical connection.

15. A method of making a co-molded seal and strain relief member, said method including the steps of:

placing a rigid strain relief member in a mold; molding a seal onto said strain relief member;

removing said co-molded strain relief and seal member from said mold;

placing said co-molded strain relief and seal member into a punch press; and removing selected seal plugs from said co-molded strain relief and seal member with said punch press.

16. The method of making a co-molded seal and strain relief member of claim 15 wherein said strain relief member includes a plurality of orifices.

17. The method of making a co-molded seal and strain relief member of claim 16 wherein said seal has a plurality of cavities molded to align with said orifices at a centerline.

18. The method of making a co-molded seal and strain relief member of claim 17 wherein said cavities include internal ribs.

19. The method of making a co-molded seal and strain relief member of claim 18 wherein said seal plugs are molded in said orifices.

20. A method of making a co-molded seal and strain relief member, said method including the steps of:

placing a rigid strain relief member in a mold, said strain relief member having a plurality of orifices;

molding a seal onto said strain relief member, said seal having cavities and selected seal plug patterns molded in alignment with said orifices to create an environmentally sealed electrical connection; and removing said co-mold seal and strain relief member from the mold.

* * * * *